US006045322A

United States Patent [19]

Breysse

[11] Patent Number: 6,045,322

[45] Date of Patent: Apr. 4, 2000

[54] METHOD AND DEVICE FOR STRAIGHTENING AND TURNING A DEFORMED STACK OF SHEET MATERIAL ON A ROLLER CONVEYOR

[75] Inventor: Regis Breysse, Vaulx-Milieu, France

[73] Assignee: Martin, S.A., Villeurbanne, France

[21] Appl. No.: 09/247,833

[22] Filed: Feb. 18, 1999

[30] Foreign Application Priority Data

Feb. 19, 1998 [FR] France ..... 98 02231

[51] Int. Cl.[7] ..... B65H 9/10

[52] U.S. Cl. ..... 414/788; 198/779; 414/801

[58] Field of Search ..... 198/779; 414/788, 414/801

[56] References Cited

U.S. PATENT DOCUMENTS

| | | | |
|---|---|---|---|
| 3,225,684 | 12/1965 | Smith | 414/788 X |
| 3,894,627 | 7/1975 | Jabbusch et al. | 198/779 X |
| 4,142,625 | 3/1979 | Bourgeois | 198/779 X |
| 4,178,118 | 12/1979 | Bailey | 414/788 |
| 5,197,849 | 3/1993 | Tübke | 414/788 |

FOREIGN PATENT DOCUMENTS

| | | | |
|---|---|---|---|
| 0066554 A1 | 12/1982 | European Pat. Off. . | |
| 4437915 C1 | 5/1996 | Germany . | |
| 2-20628 | 1/1990 | Japan | 414/788 |

*Primary Examiner*—Janice L. Krizek
*Attorney, Agent, or Firm*—Allen N. Friedman; McCarter & English, LLP

[57] ABSTRACT

A method is disclosed for straightening a stack (P) of sheet material that has been deformed after conveyance on a roller conveyor (4), the rollers of which are mounted around parallel axes of rotation (5) extending transverse to the direction of conveyance of the stack (P), consists of putting the stack (P) in engagement with a stop surface (32) and driving the axes (5) of the rollers on which the stack (P) rests in a movement of translation in the direction of conveyance of the stack (P), allowing the rollers to rotate freely around their respective axes of rotation (5).

8 Claims, 3 Drawing Sheets

METHOD AND DEVICE FOR STRAIGHTENING AND TURNING A DEFORMED STACK OF SHEET MATERIAL ON A ROLLER CONVEYOR

RELATED APPLICATIONS

This application claims priority from French Patent Application France No. 98 02231, filed Feb. 19, 1998.

GOVERNMENT FUNDED RESEARCH

Not Applicable

BACKGROUND OF THE INVENTION

1. Field of the Invention

The invention relates to a method of straightening a stack of sheet material that has been deformed after being conveyed on a roller conveyor. The rollers of the conveyor are mounted so as to rotate about parallel axes of rotation extending transversely to the direction of conveyance of the stack. The invention also relates to a device for straightening a stack of sheet material deformed by being conveyed on a roller conveyor the rollers of which have parallel axes of rotation extending transversely to the direction of conveyance. Finally, the invention relates to use of the device for changing the direction of stacks of sheet material.

2. Brief Description of the Background Art

In factories for making cardboard packaging formed by folding cardboard blanks, for example corrugated cardboard, the stacks of cardboard blanks undergo various cutting, grooving, printing operations, etc. and consequently must be conveyed over relatively large distances from one place to another in the factory. To this end, stacks of cardboard blanks up to 1.5 to 2 meters and weighing several hundred kilograms, typically 500 to 750 kg, are conveyed by conventional roller conveyors.

Because of the pressure exerted on the sheets at the bottom of the stack, the rollers cause the sheet resting on them, particularly when the sheet is of corrugated cardboard, to creep and thus slow down the sheet relative to the rest of the pile. The creeping motion is gradually transmitted over a thickness of a few centimeters from the base of the stack, giving the stack a cross-section in the shape of an elephant's foot. The deformation of course depends on the distance traveled by the stack, so that it may finally be great enough to cause the stack to fall. Of course such a risk is a danger to the safety of plant personnel, in view of the weight and height of the stacks, and the fall of a stack will also be expensive in terms of production and possible damage to the actual blanks themselves.

SUMMARY OF THE INVENTION

The main object to the invention is to provide a solution that can at least partly remedy this disadvantage. To this end, the invention relates, firstly, to a method of straightening a stack of sheet material deformed on a roller conveyor, wherein the stack is placed in engagement with a stop surface and the shafts of the rollers on which the stack rests are driven in translation in the direction of conveyance of the stack, allowing the rollers to rotate freely around their respective axes of rotation.

The invention also relates to a device for straightening a deformed stack of cardboard blanks on a roller conveyor, comprising a stop surface for the stack and at least one train of rollers mounted for rotation around parallel axes of rotation transverse to the path of conveyance of the stack on the conveyor, the respective ends of the shafts being affixed to shafts coupling the links of two respective endless chains mounted on guide and drive means, one run of the chain being underneath the stack. The drive means is adapted to move the rollers for the run of the chain underneath the stack in translation in the forward direction, the movement being conveyed to the stack by the conveyor until the stack is straightened.

Contrary to what might be thought at first, it is not sufficient to rotate the drive rollers in the opposite direction while holding back the front part of the stack. In that case the sheets at the bottom of the stack will have a corrugated shape given by the rollers and the pressure exerted by the stack, so that the rollers will slide in the bottom of the corrugations formed at the base of the stack without bringing the blanks under the stack.

As previously mentioned, deformation of the stack endangers its stability after being conveyed a certain distance, so that the device according to the invention can be disposed in the conveying chain as soon as a defined conveying distance has been reached, beyond which the conveyed stacks may become unstable.

Another object of the invention is to use the stack-straightening device in order to change the direction of the stacks. It has been found that the principle embodied by the device can be used not only to straighten deformed stacks but also to rotate the stacks, thus increasing the flexibility of the conveying chain.

Other features and advantages of the invention will be clear from the following description and the accompanying drawings which, diagrammatically and by way of example, illustrate an embodiment of the device for working the method, both being subjects of the invention.

DETAILED DESCRIPTION OF THE INVENTION

Figure 1:
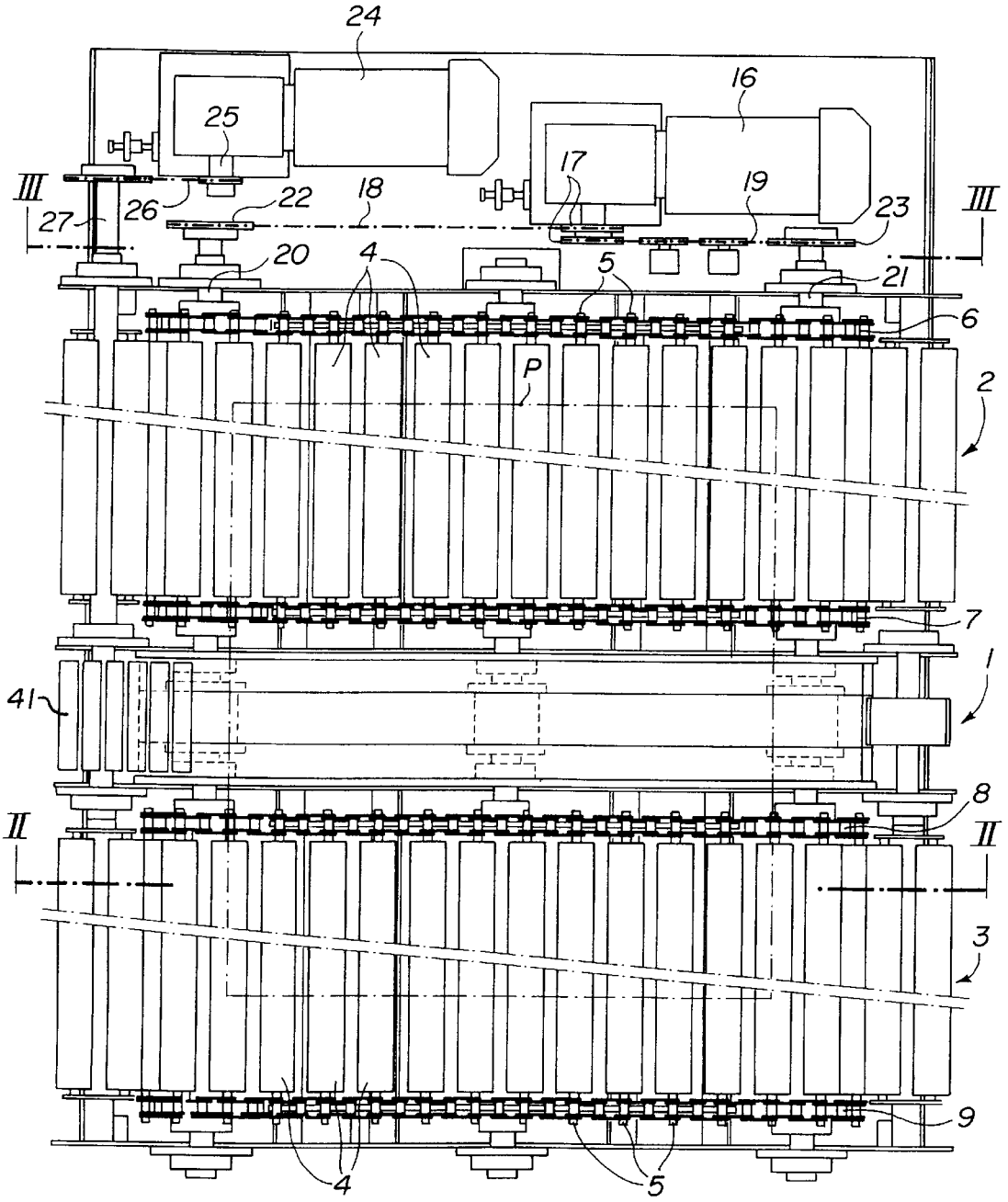
FIG. 1 is a top view of the disclosed embodiment.

FIGS. 1 to 4 illustrate a conveyor for straightening a stack of sheet material P, for example cardboard blanks, more particularly corrugated cardboard. The conveyor comprises three parallel parts, i.e. a central part 1 formed by an endless chain 41 comprised of pallets 1*a* (only a portion of which are shown), and two side parts 2, 3 each formed by a roller train with rollers 4 mounted to rotate freely around their respective axes 5. The respective ends of the axes or shafts form the coupling shaft of links of four endless chains 6, 7 for the side part 2 and 8, 9 for the side part 3.

The endless chains 6, 7 extend around two pairs of wheels 10, 11, only the pair of wheels 11 being visible on the drawings whereas the pair of wheels 10 is hidden by chains 6, 7. The endless chains 8, 9 extend around two pairs of wheels 12 and 13. The pairs of wheels 10 and 12 are secured to a common shaft 20, whereas the pair of wheels 11 and 13 are secured to a common shaft 21 (FIG. 4). The elements 6, 7, 8, 9, 11, 13, shown in phantom in FIG. 3, lie in front of the plane of the figure and below the line III—III of FIG. 1.

Figure 2:
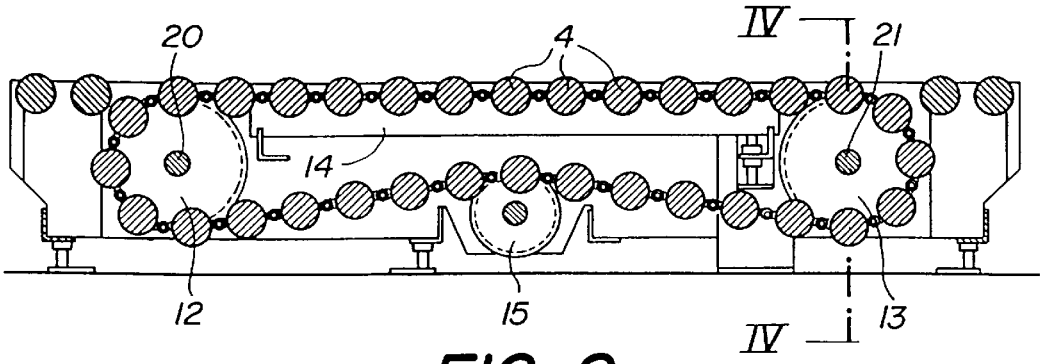
FIG. 2 is an elevational view in section along line II—II of FIG. 1.

The upper runs of each endless chain 6–9 pass over guides comprising the edges of supporting plates, one 14 of which is visible in FIG. 2, the plates being coplanar with the wheels 11–13 illustrated in FIG. 4.

The bottom runs of the said endless chains 6–9 pass over a tensioning gear 15 (FIG. 2). The rollers 4 of the roller trains on each side part 2, 3 are free to rotate about their respective axes or shafts, which are secured at their respective ends to two endless chains 6, 7 and 8, 9 respectively.

Figure 3:
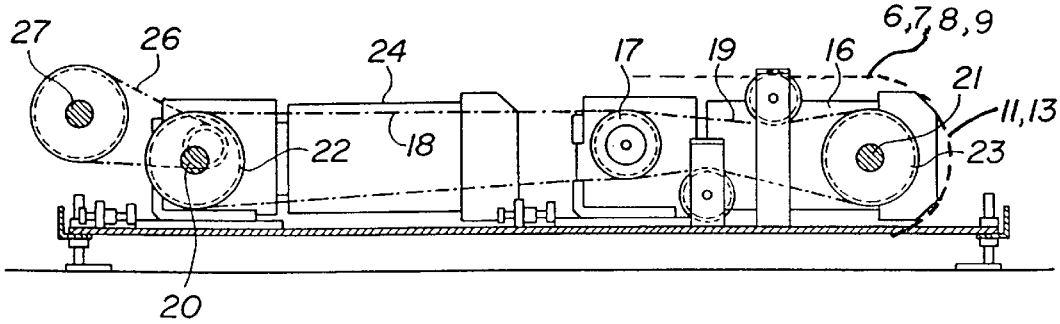
FIG. 3 is an elevational view in section along line III—III of FIG. 1.
Figure 4:
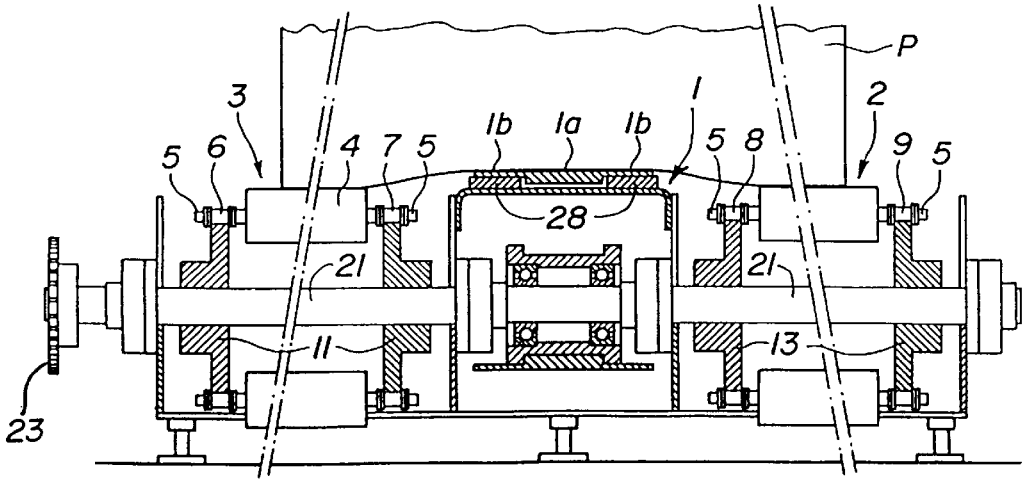
FIG. 4 is a front elevational view in section along line IV—IV of FIG. 2.

A mechanism for driving the chains 6–9 is illustrated in FIGS. 1 and 3. The mechanism comprises a motor and reduction gear unit 16 comprising a double output gear 17, each gear being in engagement with an endless chain 18, 19. The chain 18 engages a wheel 22 secured to the shaft 20, whereas chain 19 engages a wheel 23 secured to shaft 21. Thus, the two sets of roller trains forming the two side parts 2, 3 of the straightening conveyor are mechanically secured to the same shafts 20, 21 driven by the drive mechanism, which has been described.

Another mechanism, which drives the central part 1 comprising the chain of pallets 41, comprises a second motor and reduction gear unit 24 having a gear secured to an output shaft 25 and engaging an endless chain 26 adapted to transmit the motion of the output shaft 25 to a shaft 27 for driving the pallet chain of the central part 1. As shown in FIG. 4, the pallets 1*a* on the pallet chain have two thin side parts 1*b* that rest on two sliding bearings 28 in the form of strips of Teflon®, for example, or metal bars covered with that material and are secured to a part of the frame of the device under the top run of the pallet chain. As shown in FIG. 4, the level of the central part 1 corresponding to the part for driving the straightening conveyor is slightly higher than the side parts 2, 3, to ensure good contact with the stack of cardboard blanks P when the device is used for conveying instead of straightening, and so as to stop the stack P when the device is used for straightening the shape of the stack P.

The device corresponding to the embodiment of the method according to the invention is operated by placing it at the end of a conveying section having a length such that the stack may become deformed and risk becoming unstable. When the stack P arrives at the conveying and straightening device as described, the motor and reduction gear unit 24 is started and the raised central part 1 formed by the pallet chain drives the stack P by means of the center of the stack P resting on the pallet chain. The parts of the stack situated on either side of the central part 1 rest on the side parts 2, 3 of the conveyor, whose idle rollers 4 can rotate through friction against the base of the stack P when the motor and reduction gear unit 16 drives the endless chains 6–9.

When the entire stack P is on the straightening conveyor, the central part 1 is stopped and the motor and reduction gear unit 16 is started in order to drive the shafts of the rollers 4 of the rollers trains of the two side parts 2 and 3 in translation, the respective ends of the shafts being secured to chains 6, 7 and 8, 9 respectively, and the shafts being driven in the same direction as the direction of advance of the stack P. The chains 6–9 rotate, while allowing the idling rollers 4 to rotate on their respective axes 5.

Since the center of the stack P rests on the raised central part 1 of the conveyor, the stack cannot advance, but the motion of the drive chains for the side rollers is gradually communicated to the sheets at the bottom of the stack after they have been offset in the shape of an elephant's foot during previous conveyance acting to gradually undo the distortion of the stack P caused by the previous conveyance.

A photoelectric cell, for example, or other suitable detection means can detect the moment when the stack P has been straightened. Then the motor and reduction gear unit 16 is stopped.

Figure 5:
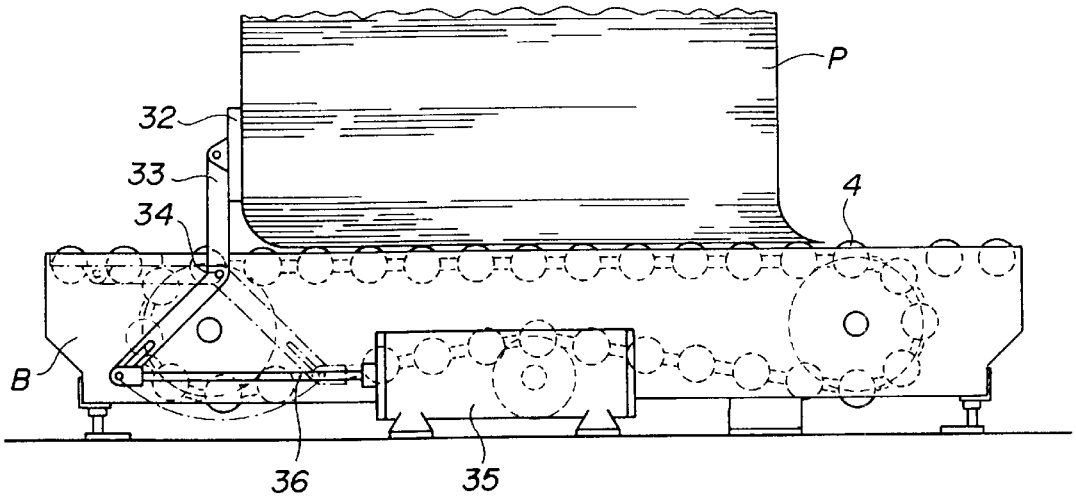
FIG. 5 is an elevational view in section of a variant of FIG. 2.
Figure 6:
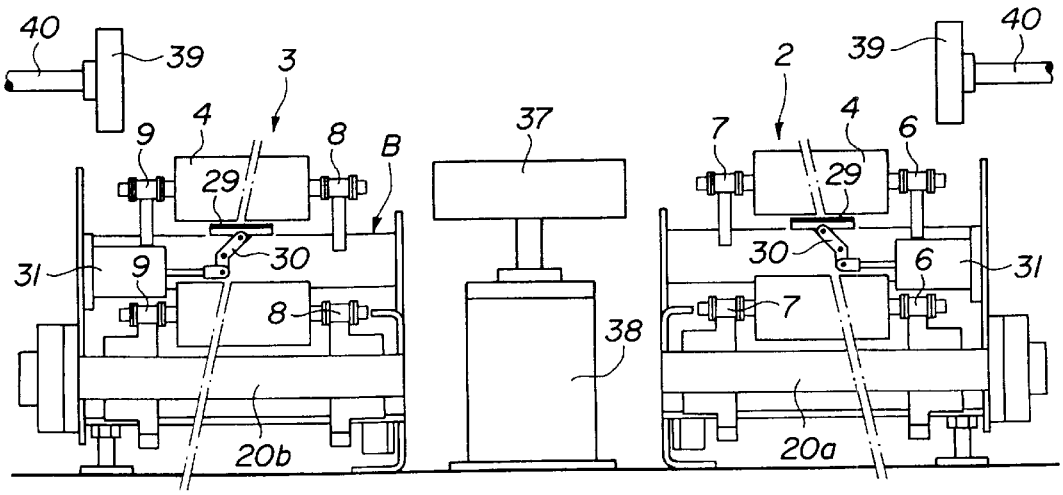
FIG. 6 is a front elevational view in section similar to FIG. 4, illustrating a variant of the device, useful for changing the direction of the stack of sheet material.

FIGS. 5 and 6 illustrate another variant of the device that has been described, and a special use of this variant. In this variant, there is no conveyor in the form of a pallet chain in the center part 1 in FIGS. 1–4. The roller trains themselves are used to drive the stack P on the straightening conveyor. To this end, friction blocks 29, acting as braking means, are each associated with a bent lever 30, one end of which is articulated to the block 29 and the other end of which engages the shaft of a jack 31, such as a hydraulic cylinder. The fulcrum of the lever is articulated to the frame B of the conveying and straightening device.

In contrast to the embodiment in FIGS. 1 to 4, the chains 6, 7 of the part 2 of the conveyor and the chains 8, 9 of part 3 thereof are not secured to the same drive shafts 20, 21 but to independent drive shafts 20*a*, 21*a* and 20*b*, 21*b* respectively, only shafts 20*a*, 20*b* being visible in FIG. 6. Shafts 20*a*, 21*a* on the one hand and shafts 20*b*, 21*b* on the other hand are each secured to an independent drive mechanism. Since these mechanisms are in all respects identical with the mechanism 16–19 in the embodiment in FIGS. 1–4, they are not described or shown again in this embodiment. Since the two parts 2 and 3 of the conveyor are independent, they can be driven at different speeds or directions, for a purpose that will be explained hereinafter.

Since the central part 1 of the embodiment in FIGS. 1–4 does not exist here, an abutment mechanism illustrated in FIG. 5 is used to stop the stack P during the straightening operation. This mechanism is situated in the central part where the pallet chain of part 1 was situated in the preceding embodiment. An abutment 32 is secured to one end of a lever 33 articulated around a pivot 34 secured to frame B. The other end of the lever 33 is articulated to the shaft 36 of a jack 35. In the position shown in continuous lines in FIG. 5, the abutment 32 is brought by lever 33 and jack 35 into a position transverse to the path of the stack of cardboard blanks P. If the jack 35 is driven in the opposite direction, i.e. by retracting the rod into the jack 35, the lever 33 pivots anti-clockwise and retracts the abutment into a position where it is no longer in the path of the stack P.

In this variant, when a stack of cardboard blanks P is brought by a roller conveyor (not shown) upstream of the device to the inlet end thereof, the jacks 31 press the blocks 29 against the respective top runs of two roller chains 4 on the side parts 2, 3 of the conveying and straightening device. Once the blocks are pressed against the rollers 4, the mechanisms for driving chains 6, 7 and 8, 9 respectively are started at the same speed, thus driving the chains and the rollers 4 secured thereto. Since the blocks 29 are simultaneously pressed against the rollers of the top runs, the rollers no longer idle as before but are driven in rotation by being moved in translation relative to the blocks 29 pressed against them. The stack P is therefore driven on the straightening device.

The abutment 32 is placed in the position illustrated in continuous lines in FIG. 5, so that the stack P is stopped as soon as it encounters the abutment 32. The roller chains are stopped and the blocks 29 are retracted so that the rollers are now free to rotate around their respective axes of rotation 5. The roller chains are then restarted but, since rollers have been released, they roll under the stack P because of friction when their axes of rotation are translated in the direction of advance of the stack P. As before, the cardboard blanks at the bottom of the stack P, which have been offset relative to the rest of the stack, are progressively moved back under the stack P, which thus regains its initial cuboidal shape.

In a second variant, the device, as shown in FIGS. 5 and 6, can also comprise a mechanism for changing the direction of the stacks after straightening them, the mechanism being positioned in the central part which, in FIGS. 1–4, is occupied by the pallet chain 1 but is unoccupied in the variant in FIGS. 5 and 6.

The device at the center comprises a disc 37 having a vertical shaft secured to the shaft of a jack 38. The disc can occupy two positions corresponding to two different levels, the first position situated below the level of the top runs of the roller chains, whereas the second position is slightly above the level of the top runs of the chains. The upper level of disc 37 is substantially the same as the level of the top run of the pallet conveyor 41 in the embodiment in FIGS. 1–4. Two centering bars 39 secured to two rods of respective jacks 40 are placed on the two sides of the conveyor above the top runs of the roller chains and on either side of the path of the stack P. The centering bars position the stack exactly at the center of the straightening conveyor. This is necessary to ensure that when the stack P is raised by the disc 37 it is well balanced thereon.

In order to rotate the stack P it is raised slightly on the disc 37, the blocks 29 are pressed against the rollers, and the two roller chains are driven in opposite directions in order to produce a torque centered around the axis of the disc, so that the stack can rotate around this axis through the desired angle. This therefore is a variant use of the last-mentioned embodiment of the straightening conveyor according to the invention.

I claim:

1. A method for straightening a stack (P) of sheet material that has been deformed after conveyance on a roller conveyor, the rollers of which are mounted around shafts (5) rotating about parallel axes of rotation extending transverse to the direction of conveyance of the stack (P), the method comprising placing the stack (P) in engagement with a stop surface (1, 32) and driving the shafts (5) of the rollers on which the stack (P) rests in translation in the direction of conveyance of the stack (P), allowing the rollers to rotate freely around their respective axes of rotation.

2. A device for straightening a stack (P) of sheet material deformed by conveyance along a path of conveyance on a roller conveyor, the rollers (4) of which have shafts (5) rotating about parallel axes of rotation extending transverse to the direction of conveyance, wherein the device comprises a stop surface (1, 32) for holding the stack (P) stationary and at least two roller trains comprising rollers (4) mounted for free rotation around parallel axes of rotation transverse to the direction of conveyance of the stack (P) on the conveyor, the respective ends of the shafts (5) being affixed to shafts coupling the links of two pairs of endless chains (6,7) (8,9) mounted on guide and drive means (10, 11, 12, 13, 16–23), the chains having upper runs proximal to the stack (P), the drive means being adapted to move the roller train rollers (4) of the upper run of each of the chains (6,7) (8,9) underneath the stack (P) in translation in the direction of conveyance, the translation movement being conveyed to the stack (P) by the rollers (4) of the roller trains until the stack is straightened.

3. A device of claim 2, wherein the stop surface comprises an abutment (32) movable between at least two positions, in a first position of which it is disposed to intercept the path of the stack (P) on the roller conveyor whereas in a second position of which it is retracted from the path, and means (33–36) for moving the abutment (32) from the first position to the second position.

4. A device of claim 2, wherein the stop surface is situated between the two roller trains, the stop surface comprising a raised surface (1) situated between the two roller trains at the center of the path of the stack (P).

5. A device of claim 4, comprising braking means (29–31) adapted to engage the rollers (4) situated in those parts of the roller trains at the upper runs of the endless chains (6,7) (8,9) so as to drive the rollers to rotate around their respective axes when the roller trains are driven in translation by the chains (6,7) (8,9).

6. A device for straightening a stack (P) of sheet material deformed by conveyance along a path of conveyance on a roller conveyor, the rollers (4) of which have shafts (5) rotating about parallel axes of rotation extending transverse to the direction of conveyance, wherein the device comprises a stop surface (1, 32) for holding the stack (P) stationary and at least two roller trains comprising rollers (4) mounted for free rotation around parallel axes of rotation transverse to the direction of conveyance of the stack (P) on the conveyor, the respective ends of the shafts (5) being affixed to shafts coupling the links of two pairs of endless chains (6,7) (8,9) mounted on guide and drive means (10, 11, 12, 13, 16–23), the chains having upper runs proximal to the stack (P), the drive means being adapted to move the roller train rollers (4) of the upper run of each of the chains (6,7) (8,9) underneath the stack (P) in translation in the direction of conveyance, the translation movement being conveyed to the stack (P) by the rollers (4) of the roller trains until the stack is straightened, wherein the stop surface is situated between the two roller trains, the stop surface comprising a raised surface (1) situated between the two roller trains at the center of the path of the stack (P), wherein the stop surface comprises an endless pallet chain (1) associated with drive means (24–27) independent of the drive means (16–23) of the endless chains (6,7) (8,9).

7. A device for straightening a stack (P) of sheet material deformed by conveyance along a path of conveyance on a roller conveyor, the rollers (4) of which have shafts (5) rotating about parallel axes of rotation extending transverse to the direction of conveyance, wherein the device comprises a stop surface (1, 32) for holding the stack (P) stationary and at least two roller trains comprising rollers (4) mounted for free rotation around parallel axes of rotation transverse to the direction of conveyance of the stack (P) on the conveyor, the respective ends of the shafts (5) being affixed to shafts coupling the links of two pairs of endless chains (6,7) (8,9) mounted on guide and drive means (10, 11, 12, 13, 16–23), the chains having upper runs proximal to the stack (P), the drive means being adapted to move the roller train rollers (4) of the upper run of each of the chains (6,7) (8,9) underneath the stack (P) in translation in the direction of conveyance, the translation movement being conveyed to the stack (P) by the rollers (4) of the roller trains until the stack is straightened, wherein the stop surface is situated between the two roller trains, the stop surface comprising a raised surface (1) situated between the two roller trains at the center of the path of the stack (P), comprising braking means (29–31) adapted to engage the rollers (4) situated in those parts of the roller trains at the upper runs of the endless chains (6,7) (8,9) so as to drive the rollers to rotate around their respective axes when the roller trains are driven in translation by the chains (6,7) (8,9)

wherein the stop surface comprises a horizontal surface (37) adapted to occupy two vertical positions, a first position above and a second position below the level of the roller trains at the upper runs of the endless chains (6,7) (8,9,), the horizontal surface (37) being mounted for pivoting around a vertical axis.

8. A method for employing the device of claim 7 for rotating the stack (P) of sheet material, wherein the horizontal stop surface (37) is brought into the first position above the level of the upper parts of the roller chains, the braking means (29–31) are applied thereto, and a first pair of the two pairs of endless chains (6,7) (8,9) is driven in a first direction and a second pair is driven in a second direction, opposite to the first direction, so as to rotate the stack (P) around the vertical pivoting axis of the horizontal stop surface (37).

* * * * *